US006305292B1

(12) United States Patent
Burczynski et al.

(10) Patent No.: US 6,305,292 B1
(45) **Date of Patent: *Oct. 23, 2001**

(54) CAPTIVE SOFT-POINT BULLET

(75) Inventors: Thomas J. Burczynski, Montour Falls, NY (US); Lawrence P. Head, Cedar; Craig S. Pilarski, Andover, both of MN (US)

(73) Assignee: Federal Cartridge Company, Anoka, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/597,017

(22) Filed: Jun. 20, 2000

Related U.S. Application Data

(63) Continuation-in-part of application No. 09/256,861, filed on Feb. 24, 1999, now Pat. No. 6,178,890.

(51) Int. Cl.[7] ..... F42B 12/34
(52) U.S. Cl. ..... 102/507; 102/516; 102/519
(58) Field of Search ..... 102/501, 502, 102/506–510, 514–519, 529

(56) References Cited

U.S. PATENT DOCUMENTS

| | | | | |
|---|---|---|---|---|
| 1,135,357 | * | 4/1915 | Clyne | 102/508 |
| 1,328,334 | * | 1/1920 | Newton | 102/508 |
| 1,967,416 | * | 7/1934 | Leussler | 102/507 |
| 3,357,357 | * | 12/1967 | Voss | 102/516 |
| 3,791,303 | * | 2/1974 | Sweeney et al. | 102/502 |
| 3,972,286 | * | 8/1976 | Canon | 102/506 |
| 4,108,074 | * | 8/1978 | Billing, Jr. et al. | 102/529 |
| 4,142,466 | * | 3/1979 | Ballreich | 102/513 |
| 4,338,862 | * | 7/1982 | Kwatnoski et al. | 102/516 |
| 5,012,743 | * | 5/1991 | Denis et al. | 102/514 |
| 5,105,744 | * | 4/1992 | Petrovich | 102/516 |
| 5,214,237 | * | 5/1993 | McArthur | 102/501 |
| 5,450,795 | * | 9/1995 | Adelman | 102/529 |
| 5,454,325 | * | 10/1995 | LeBlanc | 102/516 |
| 5,652,407 | * | 7/1997 | Carbone | 102/502 |
| 5,834,683 | * | 11/1998 | Benvegnu | 102/516 |
| 6,178,890 | * | 1/2001 | Burczynski | 102/507 |

FOREIGN PATENT DOCUMENTS

| | | | | |
|---|---|---|---|---|
| 21344 | * | of 1893 | (GB) | 102/507 |
| 002003033 | * | 11/1993 | (RU) | 102/509 |
| WO 95/00815 | * | 1/1995 | (WO) | 102/502 |
| WO 97/20185 | * | 6/1997 | (WO) | 102/507 |

* cited by examiner

*Primary Examiner*—Harold J. Tudor
(74) *Attorney, Agent, or Firm*—Schroeder & Siegfried, P.A.

(57) ABSTRACT

A bullet comprised of a jacket of malleable metal having a closed nose portion and a rear end portion defined by a cylindrical wall, the closed nose portion having wall-weakening areas encapsulating a forward core made of a deformable material which promptly deforms, collapses axially, and expands radially to a substantial extent along with the weakened wall areas, when the bullet strikes a target. The nose portion has wall-weakened areas which are ruptured by the core material to produce a collapsing and radially expanding action. These weakened wall areas are in the form of longitudinally extending, deep, internal or external, circumferentially spaced grooves with underlying web areas which are ruptured by the core material, to produce the collapsing and expanding action. This core is preferably made of rubber, urethane, silicone, or one of a substantial number of plastics, each of which has a hardness within a range of Shore A 20 to Rockwell 122.

A second core, made primarily of metal or plastic, and preferably softer than the metal of the jacket, is seated, under pressure, behind the nose core and within the rear end portion of the jacket. The advantages of the bullet result from the fact that it collapses axially and expands widely and quickly, upon striking the target, and yet penetrates an adequate distance, without losing an appreciable amount of weight, and without passing through the entire body of the target, to thereby provide an adequate penetration, optimum expansion bullet.

60 Claims, 7 Drawing Sheets

CAPTIVE SOFT-POINT BULLET

This application is a Continuation-in-Part of parent application Ser. No. 09/256,861, filed Feb. 24, 1999 entitled CAPTIVE SOFT-POINT BULLET and issued as U.S. Pat. No. 6,178,890B1 on Jan. 30, 2001.

BACKGROUND OF THE INVENTION

In December of 1988, the Federal Bureau of Investigation Academy Firearms Training Unit designed and implemented a special test protocol for evaluating the effectiveness of modern ammunition using various types of bullets. Each cartridge and bullet type submitted for testing was used in eight different Test Events. All of the tests ultimately entailed the penetration of blocks of 10% ballistic gelatin, with and without intermediate barriers in front of the gelatin. These tests included firing bullets into bare gelatin at a distance of 10 feet and through the following materials placed in front of the gelatin; heavy clothing, sheet steel, wallboard (gypsum board), plywood, automobile glass, heavy clothing at 20 yards, and automobile glass at 20 yards.

The FBI does not have a specific requirement for bullet expansion. The criterion is the volume of the wound. However, wound volume is a direct result of the rate and extent of bullet expansion. That volume is measured as the product of the extent of penetration and the frusto area resulting from the expansion. They grade sample ammunition, and the wound volume is one of the parameters used in reaching a purchasing decision. Ammunition with less than twelve (12) inches of penetration is usually not purchased. Penetration beyond eighteen (18) inches is not utilized in calculating the wound volume.

The FBI protocol is the most stringent test protocol ever devised. Many of the ammunition manufacturers soon discovered that the hollow point bullets, which they had at that time, produced very poor results in gelatin after passing through dry barriers. In an attempt to increase the robustness of their bullets, manufacturers developed bullet-weakening features to enhance post-dry-barrier expansion. These efforts were met with minimal success because ultimately, performance was still severely limited by the hollow point concept itself. Even today, many of the best hollow point bullets available perform only marginally well when tested using the FBI protocol.

Hollow point bullets rely on simple hydraulic action to initiate radial expansion. This hydraulic action occurs as fluid enters and fills the bullet's nose cavity upon impact with a fluid-based target. Because of its dependence on fluid and the actual filling of its nose cavity with fluid, a hollow point bullet expands poorly, if at all, when impacting dry, intermediate targets such as wallboard, plywood and heavy fabric. In short, without the immediate presence of fluid, the Hollow point bullet's nose cavity will clog severely after encountering almost any dry media. The material producing the worst effect on hollow point bullet performance is wallboard. This is because the gypsum dust has a tendency to pack tightly into the nose cavity which essentially transforms the bullet into a solid-nosed projectile which will, at best, exhibit minimal expansion due to the inherent strength of the core metal comprising its cavity wall. Essentially, when a dry media is substituted for fluid in its cavity, the hollow point bullet is unable to take advantage of simple hydraulics. By utilizing a completely different expansion technology, the bullet described hereinafter overcomes the inherent limitations of hollow point bullets.

BRIEF SUMMARY OF THE INVENTION

The design of our bullet is characterized by a collapsible nose portion. This type of bullet provides a limited but adequate degree of expansion while penetrating to the degree demanded by the FBI. While doing so, it retains substantially 100% of its weight.

The above bullet is comprised of a jacket of malleable metal, such as one formed predominantly of copper, and has a closed conventionally tapered nose portion and rearward cylindrically shaped sidewall which is preferably open at its rear end. The nose portions have circumferentially spaced weakened areas, which extend axially of its nose-defining wall and are preferably formed by deep internal scoring, although external scoring may be utilized. Compressed within the closed forward end of the jacket and bearing against the interior surface thereof is a soft rubber core, the rear portion of which terminates at, ahead of, or rearward of the inflection point. This inflection point is located at the juncture of the tapered nose portion and the forward end portion of the cylindrical wall of the jacket. Mounted within the cylindrical wall of the jacket is a metal core which bears against the rear end of the rubber core in compressing relation thereto. Preferably, the rear end of the metal core terminates adjacent the rear end of the cylindrical wall of the jacket, and the terminal portions of said wall thereat are crimped inwardly to lock the metal core therewithin in compressing relation to the rubber core. The forward end surface of the metal core is preferably recessed with a concave or dished out configuration. The metal core is preferably made of pure lead or some other metal which is softer than the metal of which the jacket is made.

When the above-described bullet strikes and penetrates a target which is of soft to medium-hardness, the nose portion collapses axially, which increases the pressure upon the rubber core. This causes the latter to rupture the nose-defining portions at the scored or otherwise weakened areas, and to separate along the scoring lines. As this occurs, the metal of the nose portion and the rubber core expand substantially in a radial direction, while the cylindrical wall and the metal core therewithin remain directly there behind and retain substantially 100% of their weight.

The above bullet will penetrate such materials at least twelve (12) inches and the nose portion will expand radially in excess of 50%, while retaining its weight at approximately 100%. Actual measurements show the radial expansion as great as 70%. Both the metal core and the rubber core will remain encapsulated by the metal jacket.

Our bullet will penetrate ten (10) layers of heavy denim cloth and still expand adequately in 10% ballistic gelatin. No conventional hollow-point bullet extant can duplicate or exceed this type of performance.

The front core may be comprised of EP Rubber (EPDM) which is Ethylene Propylene and is the preferred material from which that core may be made. Other suitable materials include silicone, synthetic rubber, and natural rubber.

The rear core is preferably formed of a metal which is softer than that from which the jacket is made. Pure lead is the preferred material. Other suitable metals are lead alloy, zinc or tin. This core may also be made of plastic material of suitable hardness.

The bullet give can be frusto-conical in shape or it may comprise a curving give.

It is a general object of our invention to provide a captive soft-point bullet which will overcome the disadvantages of a hollow-point bullet and will thereby out-perform all extant hollow or soft-point bullets with respect to uniform, reliable expansion and adequate penetration when fired into soft to medium-hard targets after first having passed through dry intermediate barriers such as wallboard or heavy clothing.

A further object is to provide a captive soft-point bullet which will expand radially to a relatively large diameter when fired into soft to medium-hard targets and still penetrate to a depth of at least twelve (12) inches.

Another object is to provide a captive soft-point bullet which when fired into soft to medium-hard targets will penetrate to at least twelve (12) inches while expanding radially to at least a 50–70% extent.

A still further object is to provide a captive soft-point bullet which provides 100% weight retention after first passing through intermediate barriers and thereafter impacting a soft to medium-hard target.

BRIEF DESCRIPTION OF THE DRAWINGS

These and other objects and advantages of the invention will more fully appear from the following description, made in connection with the accompanying drawings, wherein like reference characters refer to the same or similar parts throughout the several views, and in which.

DETAILED DESCRIPTION OF THE INVENTION

As described above, a number of variations of our invention are shown in FIGS. 1–9, inclusive. The jackets which are shown are all made of the same or similar material, and the forward end of the scoring may start at the closed end of the bullet or rearward thereof, and may terminate ahead of, at, or rearwardly of the inflection point which is at the rear end of the nose-defining portions. Very narrow slits may be utilized in lieu of or in combination with the scoring. Basically, the narrow slits or the scoring constitute weakened areas of the nose portion of the bullet.

Figure 2:
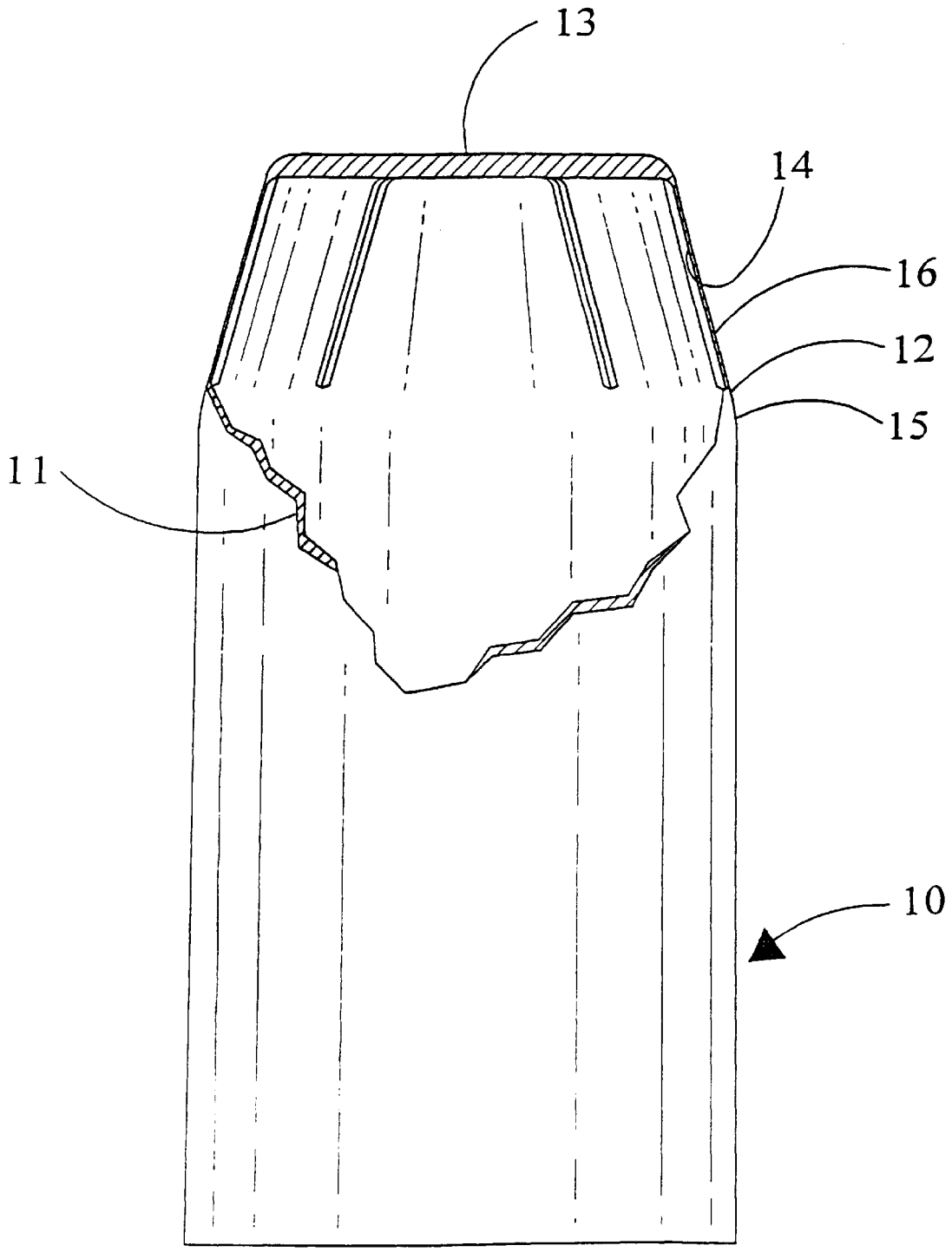
FIG. 2 is a side elevational view of the jacket shown in FIG. 1 prior to seating of the rubber core therein, with a nose portion and a portion of the cylindrical wall broken away and shown in vertical section.

As shown in FIG. 2, the jacket 10 is shown, has cylindrical wall 11 which tapers inwardly in nose-defining wall 12 which in turn terminate in a flat solid end plate 13. Internal scoring 14 extends rearwardly from the flat nose end plate 13 and terminates ahead of the inflection point 15. The scoring 14 which we utilize is deep, so as to leave only a very thin web 16 directly opposite and outwardly of the valley made by the scoring.

Figure 4:
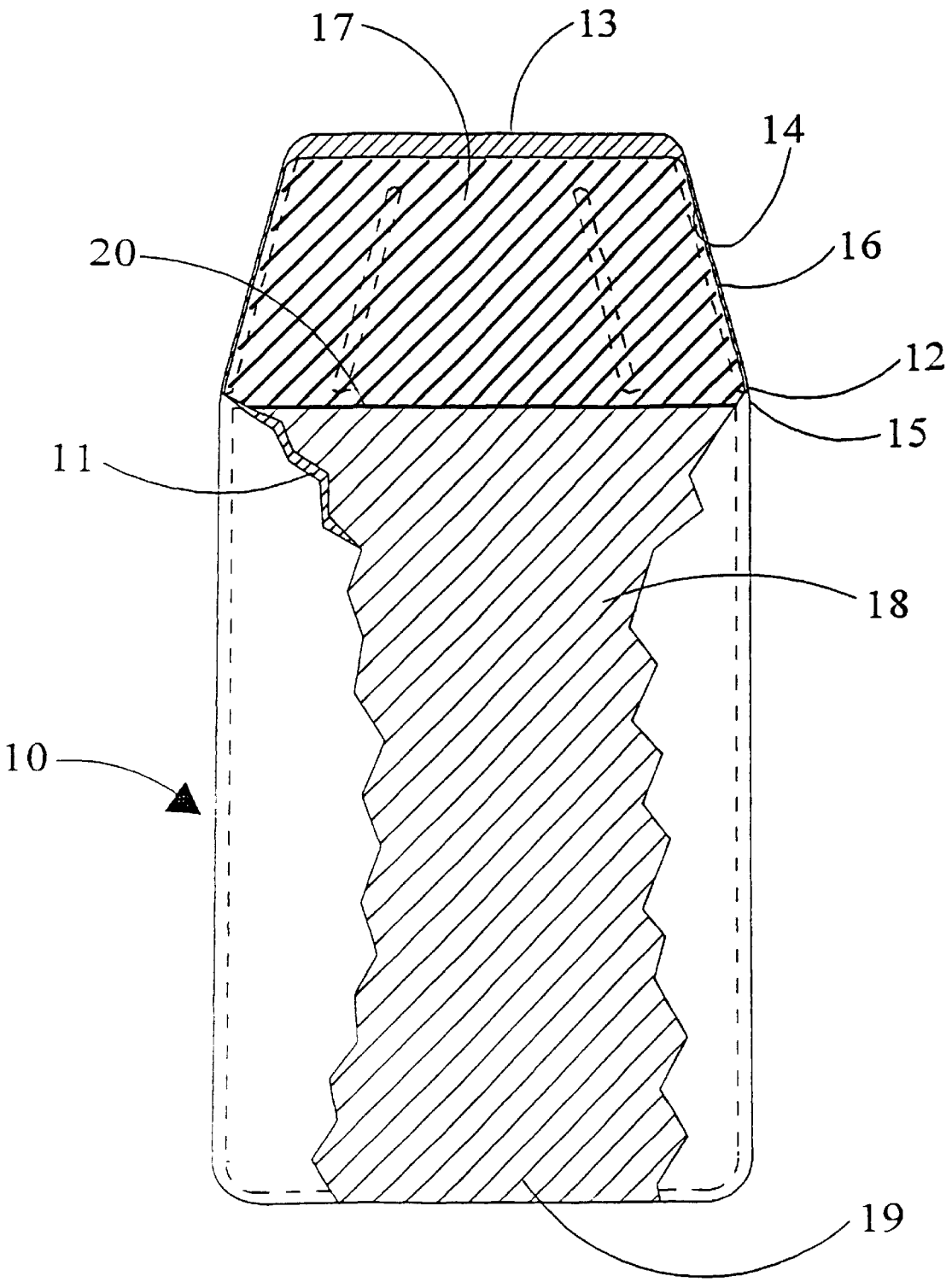
FIG. 4 is a side elevational view of the bullet shown in FIG. 3, with a portion of the cylindrical side wall broken away and a portion shown in vertical section and showing the thin web radially opposite and outside of the internal score.

In FIG. 4, as shown, the nose-defining wall 12 of the jacket 10 encapsulate a rubber core 17 which occupies the nose portion behind the end plate 13, and extend rearwardly beyond to the inflection point 15. The scores 14 extend rearwardly to the inflection point 15. Disposed immediately behind the rubber core 17 is a soft metal core 18 which fills the entire cavity of the cylindrical wall 11 from the rear end 19 thereof to the rear end of the rubber core 17. As described hereinafter, the metal core 18 in each of the variations shown herein is disposed tightly across and against the rear end of the rubber core 17 so as to urge the same against the inner surface of the end plate 13 and against the interior surface of the nose-defining portions 12. As shown, the flat forward end 20 of the soft metal core engages and is compressed against the rear surface of the rubber core.

Figure 5:
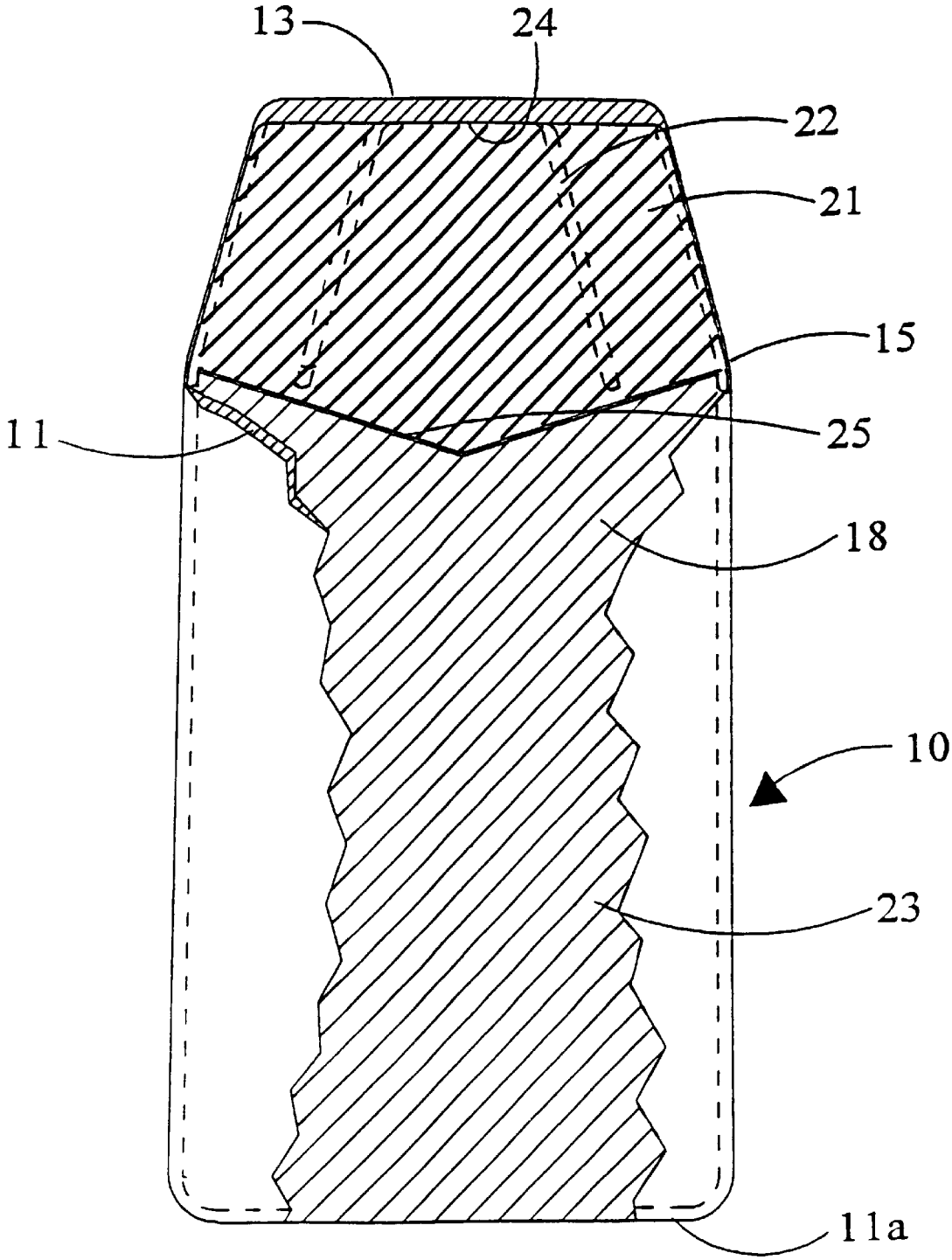
FIG. 5 is a side elevational view of a modified version of the bullet in which portions are broken away to show the nose portion in section, the forward end of the metal core is concaved and the rubber core extends rearwardly to a point behind the inflection point.

The jacket 10 is substantially the same in FIG. 5 as that shown in FIG. 4, except that the scoring 22 extends rearwardly from the inner surface of the nose plate 13 and terminates rearwardly of the inflection point 15. The forward surface 24 of the rubber core 21 is compressed against the inner surface of the nose plate 13 by the concave forward end 25 of the metal core 23 which terminates at and bears against the rear surface of the rubber core 21. The bullet shown in FIG. 5 is the preferred form of our invention.

It will be noted that the forward end of the metal core 23 is generally concaved or dished out to a depth of about 0.150" to 0.300", and the cavity thereof is filled with the rear end portion of the rubber core 21. We have found that this combination facilitates the expansion of the nose-defining portions and the rubber core 21.

As shown at the rear end of the bullet 10, the rear end portions 11*a* of the cylindrical wall 11 are crimped inwardly around the rear end of the soft metal core 23 to effectively hold the metal core 23 in pressure-bearing relation against the rubber core 21. The rear end of the metal core 23 is locked within the jacket 10 by the crimped rear end portions 11*a* of the cylindrical wall 11. As shown, the crimped portions 11*a* are embedded by the swaging actions utilized in forming the bullet, after the rubber and soft metal cores have been positioned as shown.

Figure 1:
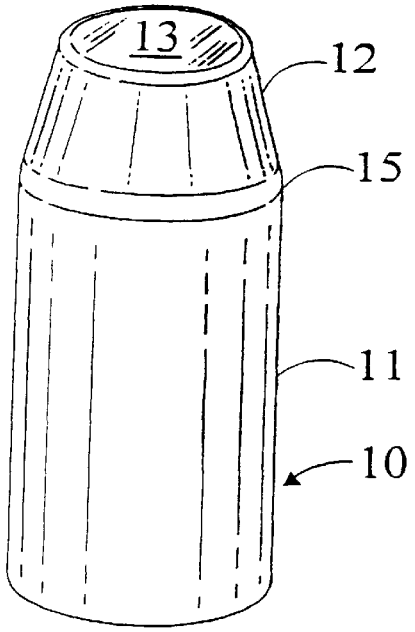
FIG. 1 is a perspective view of the bullet jacket incorporated in the invention.
Figure 3:
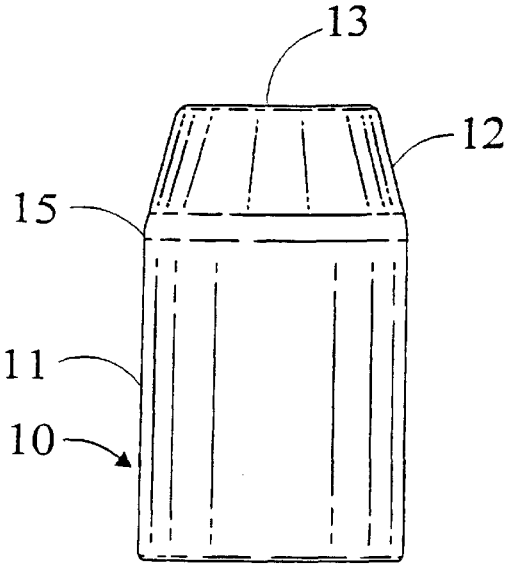
FIG. 3 is a side elevational view of the preferred form of the invention in its final form.
Figure 6:
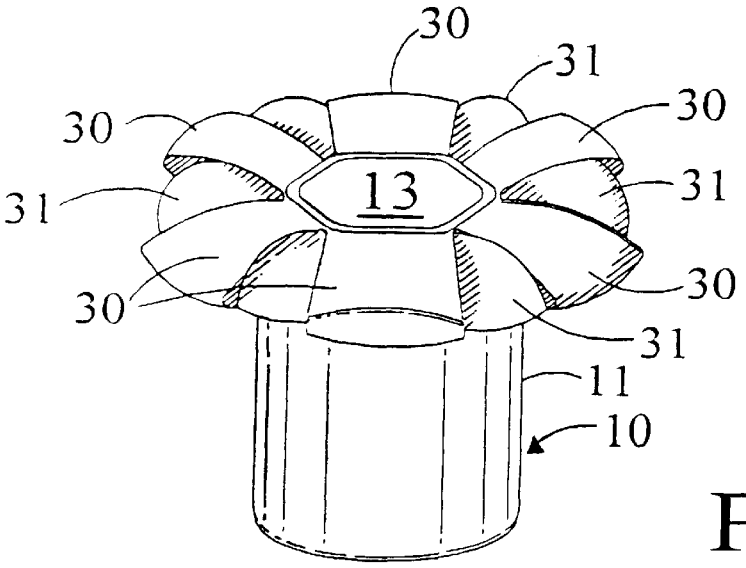
FIG. 6 is a perspective view of our preferred bullet after it has struck and penetrated a target which included a back-up consisting of a block of 10% gelatin.

FIG. 6 shows one of our bullets after it has been fired through a soft to medium hard target and penetrated through 10% gelatin a distance of approximately twelve (12) inches. It can be seen that the jacket 11 retained the metal core and the rubber core completely encapsulated. The nose portion is collapsed entirely, with the split jacket sections 30 thereof widely separated and showing the axially collapsed and radially expanded sections 31 of the rubber core visible therebetween in confined relation. The flat end plate remains intact in support of the expanded sections 30 and 31. As a consequence, the bullet has retained 100% of its original weight.

Figure 7:
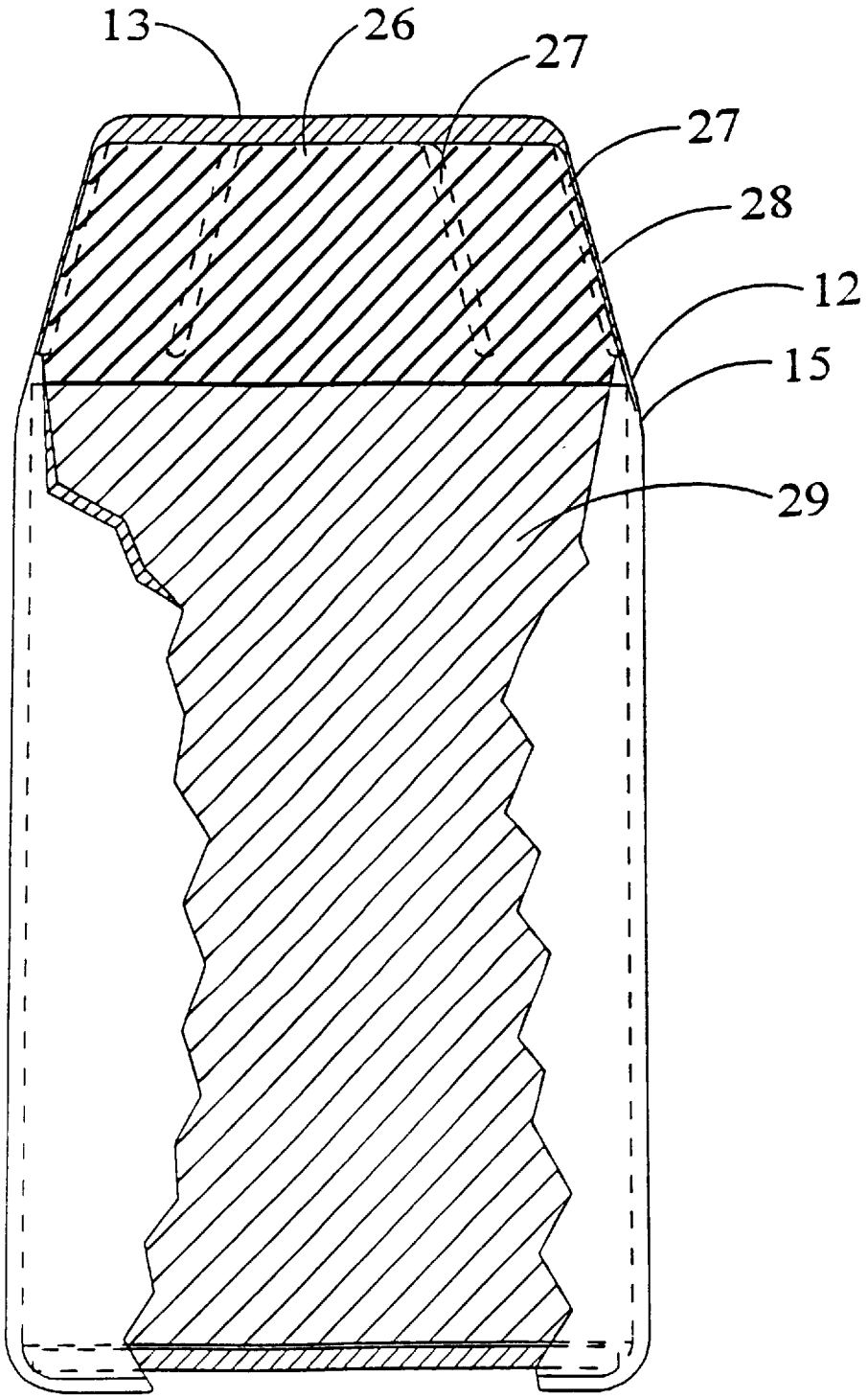
FIG. 7 is a side elevational view of our bullet with the near wall of the jacket broken away to show the interior in longitudinal section and with the rubber core extending rearwardly and terminating ahead of the inflection point.

FIG. 7 shows another form of our invention in which the scoring is located in a slightly different position. The portions of the jacket which are the same as those shown in the other views are identified by the same numerals wherever they are the same or highly similar in construction. FIG. 7 shows scoring 27 which extends rearwardly to a point forward of the inflection point 15. Since it is deep, as is the case in each of the bullets shown herein, such deep scoring leaves only a very thin web 28, which is disposed radially outwardly and directly opposite the bottom of the individual scores. It will be seen that the scores 27 originate at or near the inner surface of the nose or end plate 13. As is also shown, the rear end surface of the rubber core 26 terminates forwardly of the inflection point 15. The flat forward end of the soft metal core 29, bears against the rear end surface of the rubber core 26 and compresses the same tightly against the inner surface of the nose plate 13 and the nose defining portions 12, as well as the web 28.

Figure 8:
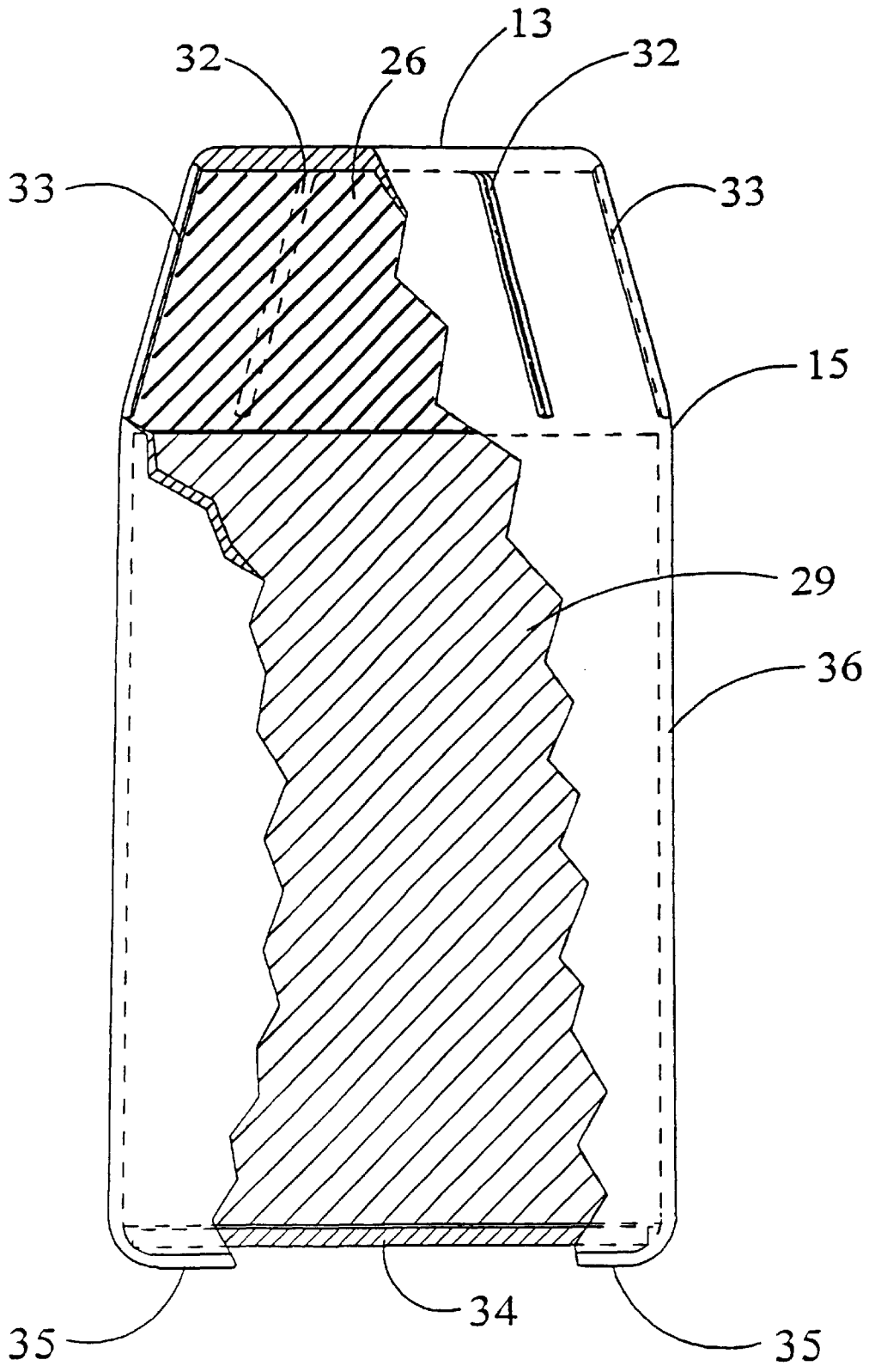
FIG. 8 is a vertical sectional view, with portions shown in elevation, of a similar jacket in which the scoring is external.

FIG. 8 shows a bullet similar to that shown in FIG. 7 except that the scoring is external, instead of internal. In view thereof, the elements of FIG. 8 are identified with some of the same numerals as those shown in FIG. 7, with the exception of the external scoring 32 and the web 33 created thereby, in lieu of the outwardly disposed web 28 of FIG. 7. The length of the scoring is the same, as is the depth thereof. If desired, a retaining disc 34 may be secured behind the metal core by the inwardly crimped rear end 35 of the sidewall 36, but we have found this disc to be non-essential.

The jacket thickness can vary substantially, since the captive soft-point bullet described herein may be used for low velocity pistol applications, high velocity pistol applications, and certain rifle applications. The latter have very high velocity characteristics. For pistol bullets, the thickness range of the jacket is approximately 0.007" to 0.040". For rifle bullets, the usable range would be approximately between 0.010"–0.090". It should be noted that although the jacket wall may be uniform originally in thickness, there is a substantial degree of wall taper in most pistol and rifle jackets which may be utilized in the formation of the jacket of our bullet. An example of the above is a typical pistol jacket which may have a thickness of 0.015" near the radius of its closed end plate and a jacket wall thickness of 0.009" at its open mouth end.

The jackets shown herein are comprised of copper or a gilding metal. These are the most common (and popular) jacket materials used in the industry. A mild steel jacket, if thin enough and malleable enough might be another alternative.

Gilding metal is a commonly used term of the art and is comprised of a copper-zinc alloy commonly used for bullet jackets. Gilding metal usually contains either 95% copper and 5% zinc or 90% copper and 10% zinc. The range of copper content is about 80% to 95%. The more zinc, the harder and less malleable will be a jacket formed thereof.

In arriving at our invention, we were looking for "relatively large" expansion and "adequate" (sufficient) penetration. When a bullet achieves deep penetration, it is usually at the cost of expansion, in that the bullet fails to expand to a sufficiently large diameter. The opposite is equally true—if the bullet expands to a large degree, penetration is compromised. The captive soft-point bullet which we have developed, along with all others, remains locked into certain terminal ballistic parameters. However, our captive soft-point bullet produces "relatively large expanded diameters" and "adequate penetration" in soft to medium-hard targets.

The forward nose or end plate 13 of our bullet is solid and closed. As a consequence, both the rubber and soft metal cores are encapsulated by the jacket upon and after impact, since the nose plate is flat and closed.

The optimum number of scores appears to be six (6). The number of scores may be either even or odd. We have found that with three (3) scores the expansion is somewhat limited, due to the additional strength provided by the extra width of the individual jacket sections 30. A greater velocity of approximately fourteen hundred (1400) feet per second or more is required to sufficiently expand such a bullet with only three (3) scores. The greater the depth of the scores the weaker the bullet nose and thus, the more rapidly it expands on impact. The greater the length of the scores, the weaker the bullet will be and the more rapidly it will expand on impact. Score length also regulates the diameter of expansion since the longer the scores, the larger the expansion.

The external scores, like the internal scores, can commence at or near the nose of the jacket and terminate forward of, at, or behind the inflection point 15. Like the internal scores, the external scores extend longitudinally of the nose-defining portions 12 and their length can be varied similarly. The depth of the external scores is similar in depth to that of the internal scores and as a consequence, the thickness of the web, which is left after the scoring is accomplished, is substantially the same as that resulting from the internal scoring. If desired, both the internal and external scoring can be made to such a depth that the thickness of the web approaches zero or, as a further alternative, a very narrow slit may be formed. Wherever hereinafter reference is made to the webs, it is intended to include a very narrow slit as an alternative for the web.

The pistol bullets described above have been tested by firing the same through various layers of denim. The greatest number of denim layers in any Federal Government Test Protocol is four (4). Our tests show that an expanding pistol bullet, made in accordance with the above, will expand markedly while passing through ten (10) layers of denim and yet will provide adequate penetration as it enters 10% back-up gelatin. There is no extant pistol bullet which will match this performance. The rubber core of the above bullets expands while penetrating the denim layers to a very substantial extent, prior to contacting the gelatin target which is disposed immediately behind the various layers of denim. The expansion occurs very rapidly in the denim and the bullet continues expanding in the gelatin.

During the initial stages of our development of the above bullet, upon impact and depending on the degree of inertia generated, the rear core would sometimes slide forward within the jacket. However, recent prototypes have been developed to a point where we have nearly eliminated all forward relative movement of the rear core at impact. Thus, the rear end portions of the rear core remain relatively flush with the base of the bullet. We have found that if the front portion of the metal core 23 is concaved, as shown in FIG. 5, the front portion of the soft metal core 23 will expand and stretch the jacket material behind the inflection point 15. This adds to the overall expanded diameter of the bullet as it reaches its maximum penetration.

It should be understood that upon impact, the scores allow the nose portion of the jacket to split. Immediately thereafter, the nose-defining portions commence to collapse axially and in doing so, the bullet expands radially. In doing so, the jacket material behind the inflection point may stretch and tear. These tears originate from the rearmost terminus of each score. In essence, they become in-line extensions of the scores and travel into the unscored area of the jacket. The additional "split length" in the unscored area adds to the diameter of the expanded bullet.

As shown in FIGS. 1–4, 7 and 8, the forward end of the metal core of our bullet may have a flat solid forward portion, or, as shown in FIG. 5, it can contain a hollow-forward portion. The shape and size of the hollow point may vary. It may appear as shown in FIG. 5 or it may have a deeper cavity or a cavity comprising a compound angle. FIG. 5 depicts the recess as being merely concave in form.

The actual rubber core may have a length within the range of 0.050"–0.350".

We have found that a web having a thickness of 0.002" is very effective. Webs which measure less than 25% of the jacket wall will function adequately at handgun velocities. The preferred thickness of the web approximates 20% of the jacket wall thickness, but it may be reduced to zero.

The preferred thickness of the cylindrical wall is 0.011". It will be seen by reference to the drawings that the front end 13 of the nose portion is thicker than the side wall of said portions and exceeds the thickness of the cylindrical wall slightly. This is a natural result of the forming of the jacket from a conventional bullet jacket having one closed end and the other end being open.

The bullets described hereinabove, as shown in the drawings hereof, have been found to be highly effective, particularly for law enforcement purposes. In law enforcement operations, a bullet frequently must pass through soft to medium-hard materials before engaging the true (ultimate) target, and thereafter penetrate the body of the true (ultimate) target. This ultimate target will frequently involve at least one or more layers of clothing, before entering the flesh of the ultimate target which is relatively soft, much like 10% gelatin. Frequently, bones are encountered by the bullet and for that reason, substantial penetration is desired. Also, the expanded bullet conveys substantial shock. The bullets shown and described hereinabove have been found to be unusually effective for such law enforcement purposes. As indicated above, these bullets will penetrate as many as ten (10) layers of denim, and still sufficiently penetrate the target there behind, while continuing to expand a substantial distance radially to provide substantial shock and wound volume to the ultimate target. As indicated above, we have found that these bullets will expand radially as much as 50–70% and yet penetrate to a distance of approximately 12" or more. For these reasons, these bullets for use against soft to medium-hard targets are much more effective than any extant bullet.

Since the filing of the U.S. parent patent application, Ser. No. 09/256,861 by me, Thomas J. Burczynski, filed Feb. 24, 1999 and entitled "CAPTIVE SOFT-POINT BULLET," we have confirmed that a number of additional compositions can be successfully utilized in our above bullet. In view thereof, and in view of the fact that the assignee hereof desires an early issuance of the patent on our above parent application, the instant application is being filed as a continuation-in-part of our said allowed parent application Ser. No. 09/256,861, for the purpose of widening the scope of the protection as claimed in said parent application, and to enumerate and claim the specific additional materials which may be utilized in lieu of the materials disclosed and claimed in said parent application Ser. No. 09/256,861.

Figure 9:
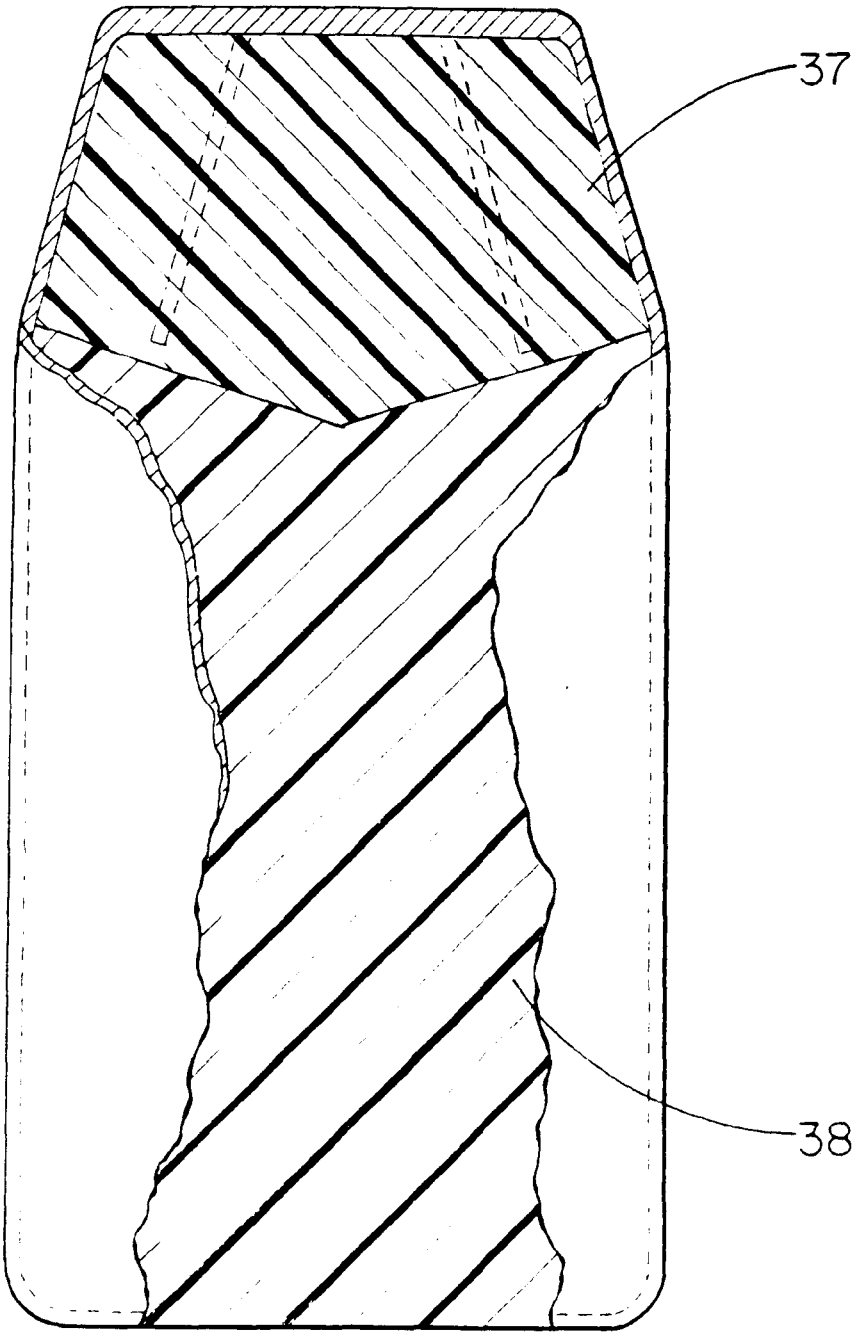

FIG. 9 is a side elevational view of a bullet in which portions are broken away to show the plastic nose core in section, and a plastic rear core partially in section.

We have added FIG. 9 in order to meet the requirements to show everything which is claimed. FIG. 9 is similar to FIG. 5 of the parent application, Ser. No. 09/256,861, but differs in that plastic material is shown in the nose core 37 in lieu of rubber, and the rear core 38 is shown in a harder plastic form.

The rear plastic core 38 must be sufficiently harder than the plastic nose core 37 so as to cause the latter to collapse and expand radially when the bullet strikes a target, without sufficient deformation of the rear core 38 to adversely affect the performance of the bullet. If desired, a core comprised primarily of metal may be utilized in lieu of plastic core 38.

Listed below are some materials which may be utilized in the nose core 17. We have obtained the hardness ranges listed below from Matweb, which is a website on the Internet. The website address is http://www.matweb.com/.

| Material Tested | Preferred Material Hardness | Acceptable Hardness Range |
|---|---|---|
| Rubber | Shore A 50 | Shore A 20–90 |
| Silicone Ruber | Shore A 50 | Shore A 20–80 |
| Low Density Polyethylene (LDPE) | Shore D 45 | Shore D 45–60 |
| High Density Polyethylene (HDPE) | Shore D 66 | Shore D 66–73 |
| Nylon ™ | R 94 | R 94–120 |
| Urethane | Shore A 50 | Shore A 20–70 |
| PVC (Flexchem) ™ | Shore A 50 | Shore A 35–65 |
| Ethylene Vinyl Acetate | Shore A 58 | Shore A 58-D 93 |
| Polypropylene | R 80 | R 80–102 |
| Polystyrene | R 75 | R 75–110 |
| Polycarbonate | R 108 | R 108–122 |

As suggested above, we have since determined that silicone rubber is an excellent material from which to make the soft nose core 17. Silicone rubber has an acceptable hardness range of Shore A20–80. The preferred hardness is Shore A 50. It has certain physical properties which lend themselves to produce a highly effective collapsible nose portion which collapses axially and then expands radially and extensively in a radial direction as sections 30, along with the expanded metal sections 31 of the nose section of the jacket. It compares favorably with the rubber of our above parent application, which has a hardness range of Shore A 20–80, and a preferred hardness of Shore A 50, and silicone rubber is substantially equivalent in price.

We also contemplate the use of PVC, which is sold on the market under the trademark Flexchem™, since it has properties which would make a similar bullet having a soft nose core similar to the rubber nose core 17, which will function in an equally satisfactory manner.

Ethylene vinyl acetate also has hardness properties which will cause it to function as an adequate substitute for rubber in the soft nose core 14. We have also found that Nylon™ will function adequately when the soft nose core of our invention is formed from that material. Also, low density and high density polyethylene have been tested and found to function in a suitable manner as a material from which the relatively soft nose core may be formed.

We have also determined that desirable results can be obtained by using our invention in rifles, particularly at the higher velocities. We have found that, if the velocities are increased, and the thickness of the cylindrical wall of the jacket is increased so as to avoid rupture of the cylindrical side wall, very desirable similar results are obtained, because the nose portion will collapse axially and expand radially, upon the bullet striking the target, in the same manner as that produced with a rubber nose core and a thinner side wall, at the lower velocities.

The typical low-velocity bullets (pistol) travel at a speed of about 600 fps to 1800 fps. The typical medium-velocity rifle bullets, travel at a velocity of about 1800 fps to 2500 fps. The typical high-velocity range for rifle bullets is about 2500 fps to 4000 fps. The nose core durometer range for the low to-medium velocity bullets is about Shore A20–Shore D73. The nose core durometer range for the high-velocity rifle bullets in our invention is about Shore A20–R122. The preferred jacket thickness for the medium-to-high velocity rifle bullets in our invention is from about 0.010" to 0.090". The preferred jacket wall thickness for the low velocity (pistol) bullet is about 0.011"–0.015". The preferred range of thickness of the webs is about 0.002"–0.008".

Some chemical compounds which will function as described above when used as nose cores in rifle bullets at the above-described velocities include polypropylene, fluorocarbons, polystyrene, and polycarbonate. Although they have higher measures of hardness than the rubbers, they will collapse axially and expand radially and quickly, upon the bullet striking a target.

The polypropylene has a hardness of R80–102 and the preferred hardness is R80.

The polystyrene will function well when used as a nose core within a hardness range of R75–110. The preferred hardness measure of this plastic for use in high velocity bullets is about R75.

The polycarbonate also functions well when used as a nose core in high-velocity bullets if the hardness thereof is within the range of R108–122. The preferred hardness level of the polycarbonates for use as nose cores in high-velocity bullets for rifles is about R108.

Each of the other materials previously described as being suitable for use in nose cores, such as cores 14 and 27, will function to collapse and expand radially upon the bullet striking a target, as described above.

Thus natural rubber, rubber elastomers, silicone rubber, low and high-density polyethylene, Nylon™, PVC, urethanes, and ethylene vinyl acetate will each function well in high, as well as in the low, velocity bullets.

The most satisfying material from which to manufacture the nose core of our captive soft-point bullet, that we have found to date, is silicone rubber.

We have found that low-velocity bullets having a nose core comprised of silicone rubber function very well, in that the bullet nose, upon the bullet striking the target, will penetrate said target, and the nose portion will thereafter quickly collapse axially, and expand radially in all directions to a substantial extent. As a consequence, the bullet imparts substantial shock to the target, which is desirous. The bullet will continue in a relatively straight path within the target and will lodge within the interior of the same without any appreciable weight loss, which is desirous. By maintaining substantially 100% of its initial weight, such a bullet transmits maximum shock value to the target.

Similar effects as described above can be accomplished if it is desired to obtain the same at rifle velocities. The higher the rifle bullet velocities being used, the harder the nose core material which may be used within the nose core to obtain results similar to those described above. We have found, however, that considerable variance is permissible in the selection from the various plastics which have durometer readings extending over a substantial range.

In general, nose cores manufactured of all of the materials identified as suitable for that purpose will function adequately at the higher velocities, but the plastic materials having the high hardness durometer values will not function well at the lower velocities.

It will, of course, be understood that various changes may be made in the form, details, arrangement and proportions of the parts without departing from the scope of the invention which comprises the matter shown and described herein and set forth in the appended claims.

What is claimed is:

1. An adequate penetration, optimum expansion bullet for use against targets of soft to medium-hardness comprising:

(a) a jacket formed of a malleable metal and having a generally cylindrical sidewall, a nose portion disposed forwardly of said cylindrical sidewall, a closed forward end, and a rear end portion;

(b) said nose portion having a nose-defining wall extending between said cylindrical wall and said closed forward end;

(c) said nose-defining wall having circumferentially spaced wall-weakening scores formed therein and extending axially of said nose portion;

(d) a polymeric core disposed in part at least within said nose-defining wall and against said closed forward end, said polymeric core having a hardness or durometer within a range of Shore A20–Rockwell R-122;

(e) a metal core seated behind said polymeric core and within said generally cylindrical sidewall in close-fitting relation and extending rearwardly to a position adjacent said rear end portion of said generally cylindrical jacket sidewall;

(f) said nose-defining wall being weakened by said scores sufficiently to cause said nose-defining wall, upon the bullet striking and penetrating a target, to rupture along said scores and thereafter to expand substantially in a radial direction, together with said polymeric core.

2. The bullet defined in claim 1, wherein said scores are of such a length and depth so as to cause the axial collapse of said nose portion and said polymeric core, upon the bullet striking and penetrating a target.

3. The bullet defined in claim 1, wherein said scores are of such a length and depth so as to cause said nose portion and said polymeric core, upon the bullet striking and penetrating a target, to collapse axially and expand substantially radially, while retaining said metal core in encapsulated relation.

4. The bullet defined in claim 1, wherein said nose portion of said jacket has an inner surface, and said scores are formed in said inner surface.

5. The bullet defined in claim 1, wherein said scores are of such a length and depth so as to cause said nose portion and said polymeric core, upon the bullet striking and penetrating a target, to collapse axially and expand radially, and to cause said metal core to maintain its position adjacent the rear end of the bullet and behind said expanded polymeric core and nose portion.

6. The bullet defined in claim 1, wherein upon the bullet striking and penetrating a target, its weight retention approaches 100%.

7. The bullet defined in claim 1, wherein said scores are of such lengths and depths sufficient, upon the bullet striking and penetrating a target, to cause said nose portion and said polymeric core to collapse axially and to expand radially, while maintaining at least 75% of said polymeric core in encapsulated relation.

8. The bullet defined in claim 1, wherein upon the bullet striking and penetrating a target, said metal core is entirely retained within the confines of said jacket.

9. The bullet defined in claim 1, wherein said polymeric core occupies the major portion of the interior of said nose portion.

10. The bullet defined in claim 1, wherein said metal core has a recessed generally concave forward end surface engaging said polymeric core.

11. The bullet defined in claim 1, wherein said nose-defining wall is weakened by said scores sufficiently to cause said nose portion, upon the bullet striking and penetrating a target, to rupture along said scores and collapse axially and to expand radially, while maintaining each of said cores in encapsulated relation.

12. The bullet defined in claim 1, wherein, said nose-defining wall is weakened by said scores sufficiently to cause said nose-defining wall, upon the bullet striking and penetrating a target, to rupture along said scores and to collapse axially and expand radially, while maintaining each of said cores in at least 90% encapsulated relation.

13. The bullet defined in claim 1, wherein said scores are circumferentially spaced substantially equidistantly.

14. The bullet defined in claim 1, wherein said polymeric core and said metal core are hard-seated within said jacket against said closed forward end of said jacket.

15. The bullet defined in claim 1, wherein said nose-defining wall includes at least a thin web of metal disposed directly radially opposite at least one of said wall-weakening scores, said web rupturing along said score upon the bullet striking and penetrating a target at least twelve (12) inches, and thereby permitting said nose-defining wall to separate along said scores and together with said polymeric core, to collapse axially and expand substantially in a radial direction.

16. The bullet defined in claim 1, wherein the thickness of said web is within the range of 0.001"–0.039".

17. The bullet defined in claim 1, wherein said polymeric core is comprised of a material taken from a group of deformable-under-pressure materials which includes urethanes, fluorocarbons, polycarbonates, polypropylenes, polystyrenes, polyethylenes, PVC™, silicone rubber, Nylon™, and vinyl acetate.

18. The bullet defined in claim 1, wherein said polymeric core extends rearwardly at least as far as said cylindrical sidewall.

19. The bullet defined in claim 1, wherein said cylindrical sidewall has a terminal portion crimped radially inwardly around a rear end portion of said metal core.

20. An adequate penetration, optimum expansion bullet for use against targets of soft to medium-hardness comprising:

(a) a jacket formed of a malleable metal and having a generally cylindrical sidewall, a nose portion disposed forwardly of said cylindrical sidewall, a closed forward end, and a rear end portion;

(b) said nose portion having a nose-defining wall extending between said cylindrical wall and said closed forward end;

(c) said nose-defining wall having spaced weakened areas therein subject to rupture thereat by internal pressures created when the bullet strikes a target;

(d) a polymeric core disposed in part at least within said nose-defining wall adjacent said weakened areas and occupying at least a substantial portion of the interior of said nose portion, said polymeric core having a hardness or durometer within the range of Shore A20–Rockwell R-122;

(e) a metal by seated behind said polymeric core within said generally cylindrical wall and arranged in pressure-bearing relation with said closed forward end through said polymeric core;

(f) said weakened areas being weakened sufficiently to cause said polymeric core, upon the bullet striking and penetrating a target, to rupture at least some of said weakened areas, and thereafter, together with said ruptured weakened areas, to expand substantially in a radial direction.

21. The bullet defined in claim 20, wherein the jacket is formed mainly of copper.

22. The bullet defined in claim 20, wherein the thickness of the cylindrical sidewall of said jacket approximates 0.011".

23. The bullet defined in claim 20, wherein the thickness of the cylindrical sidewall of said jacket is within the range of 0.007"–0.040".

24. The bullet defined in claim 20, wherein said weakened areas extend throughout a major portion of the axial length of said nose-defining wall.

25. The bullet defined in claim 20, wherein at least some of said weakened areas extend axially only a portion of the axial length of said nose-defining wall.

26. The bullet defined in claim 20, wherein at least some of said weakened areas extend throughout the axial length of said nose-defining wall.

27. The bullet defined in claim 20, wherein at least some of said weakened areas have a thickness which is less than 25% of the thickness of said cylindrical sidewall.

28. The bullet defined in claim 20, wherein the thickness of each of said weakened areas is less than 40% of the thickness of said cylindrical sidewall.

29. The bullet defined in claim 20, wherein the thickness of at least some of said weakened areas approximates 10% of the thickness of said cylindrical sidewall.

30. An adequate penetration, optimum expansion bullet for use against targets of soft to medium-hardness comprising:

(a) a jacket formed of a malleable metal and having a generally cylindrical sidewall, a nose portion disposed forwardly of said cylindrical sidewall, a closed forward end, and a rear end portion;

(b) said nose portion having a nose-defining wall extending between said cylindrical wall and said closed forward end;

(c) said nose-defining wall having circumferentially spaced, longitudinally extending weakened areas subject to rupture thereat by internal pressures created when the bullet strikes and penetrates a target, (d) a first-mentioned polymeric core disposed, in part at least, within said nose-defining wall adjacent said weakened areas and occupying at least a substantial portion of the interior of said nose portion, said first-mentioned polymeric core having a hardness or durometer within the range of Shore A20–Rockwell R-122;

(e) a second-mentioned polymeric core hard-seated behind said first-mentioned polymeric core within said generally cylindrical wall in close-fitting relation and being harder than said first-mentioned core and constructed and arranged in pressure-bearing relation against said first-mentioned polymeric core and against said closed end through said first-mentioned polymeric core;

(f) said weakened areas being weakened sufficiently to cause said first-mentioned polymeric core, upon the bullet striking and penetrating a target, to rupture at least some of the weakened areas, and thereafter, together with said weakened areas, to expand to a substantial extent in a radial direction, said first-mentioned polymeric core being made of a material taken from a group of deformable-under-pressure materials which includes urethanes, fluorocarbons, polycarbonates, polypropylenes, polystyrenes, polyethylenes, PVC™, silicone rubber, Nylon™, and vinyl acetate.

31. The bullet defined in claim 30, wherein at least some of said weakened areas have a thickness of about 0.001".

32. The bullet defined in claim 30, wherein at least some of said weakened areas have a length of about 0.200".

33. The bullet defined in claim 30, wherein said weakened areas have a thickness within the range of 0.001"–0.039".

34. An adequate penetration, optimum expansion bullet for use against targets of soft to medium hardness comprising:

(a) a jacket formed of a malleable metal and having a generally cylindrical sidewall, a nose portion disposed forwardly of said cylindrical sidewall, a closed forward end, and a rear end portion;

(b) said nose portion having a nose-defining wall extending between said cylindrical wall and said closed forward end;

(c) said nose-defining wall having circumferentially spaced weakened areas subject to rupture thereat by internal pressures created when the bullet strikes and penetrates a target;

(d) a polymeric core disposed in part at least within said nose-defining wall adjacent said weakened areas and occupying at least a substantial portion of the interior of said nose portion, said polymeric core having a hardness or durometer within the range of Shore A20–Rockwell R-122;

(e) a metal core firmly seated within said generally cylindrical wall behind said polymeric core and confining at least a substantial portion of said polymeric core within the interior of said nose portion;

(f) said weakened areas being weakened sufficiently to cause said polymeric core, upon the bullet striking and penetrating a target, to rupture at least some of said weakened areas and thereafter, together with said weakened areas, to expand to a substantial extent in a radial direction.

35. The bullet defined in claim 34, wherein said jacket is formed of a material comprised of about 80%–95% copper and has walls which are about 0.011" thick.

36. The bullet defined in claim 34, wherein the cylindrical wall of said jacket has a thickness within the range of 0.007"–0.040".

37. The bullet defined in claim 34, wherein said nose-defining wall is scored longitudinally of said nose portion.

38. The bullet defined in claim 34, wherein said nose-defining wall is scored internally.

39. The bullet defined in claim 34, wherein said nose-defining wall is scored externally.

40. The bullet defined in claim 34, wherein said nose-defining wall is weakened with very narrow longitudinally extending slits.

41. The bullet defined in claim 34, wherein said nose-defining wall is scored deeply but not entirely therethrough, leaving a web of said wall extending directly outwardly and longitudinally of said scoring, said web being about 0.002" thick.

42. The bullet defined in claim 34, wherein said polymeric core is about 0.050"–0.350" in length.

43. The bullet defined in claim 34, wherein said metal core has a forward end with a hollow-point cavity in the forward end thereof.

44. The bullet defined in claim 34, wherein said weakened areas are comprised of scores and said scores extend rearwardly at least as far as the forward end of said cylindrical wall.

45. The bullet defined in claim 34, wherein said weakened areas are formed by scoring and said scored areas are restricted to said nose-defining wall.

46. The bullet defined in claim 34, wherein said jacket has an open rear end and said cylindrical wall has a rear end portion crimped radially inwardly to secure said metal core therewithin.

47. The bullet defined in claim 34, wherein said weakened areas are comprised of scored areas extending along at least a portion of the length of said cylindrical wall.

48. The bullet defined in claim 34, wherein said weakened areas are comprised of scored areas extending along at least a portion of the length of said nose-defining wall.

49. The bullet defined in claim 34, wherein said weakened areas are weakened by internal scores having a score-depth less than the thickness of said nose-defining wall.

50. The bullet defined in claim 34, wherein said weakened areas are weakened by external scores having a score depth less than the thickness of said nose-defining wall.

51. The bullet defined in claim 34, wherein said weakened areas are weakened by very narrow slits formed in said nose-defining wall.

52. The bullet defined in claim 34, wherein said polymeric core occupies the entire space within said nose portion of said jacket.

53. The bullet defined in claim 34, wherein said polymeric core occupies the entire space within said nose portion of said jacket as well as a portion of the space within said cylindrical wall.

54. The bullet defined in claim 34, wherein said metal core has a flat, solid forward end.

55. The bullet defined in claim 34, wherein said metal core has a forward end with a hollow-point formed therein.

56. The bullet defined in claim 34, wherein said metal core has a forward end with a hollow-point formed therein to a depth of between about 0.150" and 0.300".

57. The bullet defined in claim 34, wherein said metal core occupies the entire space within said cylindrical wall of said jacket.

58. The bullet defined in claim 34, wherein said metal core occupies only a portion of the space within said cylindrical wall of said jacket.

59. The bullet defined in claim 34, wherein said metal core occupies the entire space within said cylindrical wall and a portion of the space within said nose portion as well.

60. The bullet defined in claim 34, wherein said polymeric core is comprised of rubber.

* * * * *

UNITED STATES PATENT AND TRADEMARK OFFICE

CERTIFICATE OF CORRECTION

PATENT NO. : 6,305,292 B1 
DATED : October 23, 2001
INVENTOR(S) : Thomas J. Burczynski, Lawrence P. Head and Craig S. Pilarski It is certified that error appears in the above-identified patent and that said Letters Patent is hereby corrected as shown below:

Column 1,
Line 7, immediately below BACKGROUND OF THE INVENTION, insert -- This invention relates to the development of a metal-jacketed, non-hollow point bullet intended for law enforcement use which exhibits optimum penetration and more reliable and consistent expansion than hollow point bullets when fired through dry materials such as wallboard, plywood and heavy clothing, while maintaining 100% weight retention. --

Column 2,
Lines 59 and 60, please delete "give" (both occurrence) and insert -- ogive --.

Column 11,
Line 53, subparagraph (e), please delete "by" and insert -- core --.

Signed and Sealed this

Eleventh Day of June, 2002

*Attest:*

*Attesting Officer*

JAMES E. ROGAN
*Director of the United States Patent and Trademark Office*